US011091846B2

(12) United States Patent
Bisselink

(10) Patent No.: US 11,091,846 B2
(45) Date of Patent: Aug. 17, 2021

(54) ELECTROCHEMICAL PROCESS AND REACTOR

(71) Applicant: STICHTING WAGENINGEN RESEARCH, Wageningen (NL)

(72) Inventor: Roel Johannes Martinus Bisselink, Kleve (DE)

(73) Assignee: STICHTING WAGENINGEN RESEARCH, Wageningen (NL)

( * ) Notice: Subject to any disclaimer, the term of this patent is extended or adjusted under 35 U.S.C. 154(b) by 131 days.

(21) Appl. No.: 16/312,522

(22) PCT Filed: Jun. 23, 2017

(86) PCT No.: PCT/NL2017/050421
§ 371 (c)(1),
(2) Date: Dec. 21, 2018

(87) PCT Pub. No.: WO2017/222382
PCT Pub. Date: Dec. 28, 2017

(65) Prior Publication Data

US 2019/0161869 A1 May 30, 2019

(30) Foreign Application Priority Data

Jun. 24, 2016 (EP) ..... 16176252
Aug. 19, 2016 (EP) ..... 16184995

(51) Int. Cl.

| | |
|---|---|
| ***C25B 1/30*** | (2006.01) |
| ***C25B 3/00*** | (2021.01) |
| ***C25B 9/23*** | (2021.01) |
| ***C25B 13/08*** | (2006.01) |

(52) U.S. Cl.
CPC ..... *C25B 1/30* (2013.01); *C25B 3/00* (2013.01); *C25B 9/23* (2021.01); *C25B 13/08* (2013.01)

(58) Field of Classification Search
CPC ..... C25B 1/30; C25B 9/08; C25B 9/10
See application file for complete search history.

(56) References Cited

U.S. PATENT DOCUMENTS

| | | | | |
|---|---|---|---|---|
| 5,437,771 A * | 8/1995 | Shimamune | ..... | C25B 1/30 204/265 |
| 6,254,762 B1 * | 7/2001 | Uno | ..... | C25B 1/30 204/263 |
| 9,926,634 B2 * | 3/2018 | Bisselink | ..... | C25B 9/08 |
| 2004/0007476 A1 | 1/2004 | Tennakoon et al. | | |

(Continued)

FOREIGN PATENT DOCUMENTS

EP 1103264 A3 5/2003

OTHER PUBLICATIONS

International Search Report, prepared by the European Patent Office, dated Sep. 7, 2017 for International (PCT) Application No. PCT/NL2017/050421 (4 pages).

(Continued)

*Primary Examiner* — Salil Jain
(74) *Attorney, Agent, or Firm* — Pearne & Gordon LLP

(57) ABSTRACT

A solid ion-conductive material can be used in a compartment of an electrochemical cell, such as between an anion exchange membrane and a cation exchange membrane, for improving energy efficiency and at least partially replacing electrolyte solution. The formed product can be obtained for instance in demi water.

13 Claims, 4 Drawing Sheets

(56) References Cited

U.S. PATENT DOCUMENTS

Figure 1:
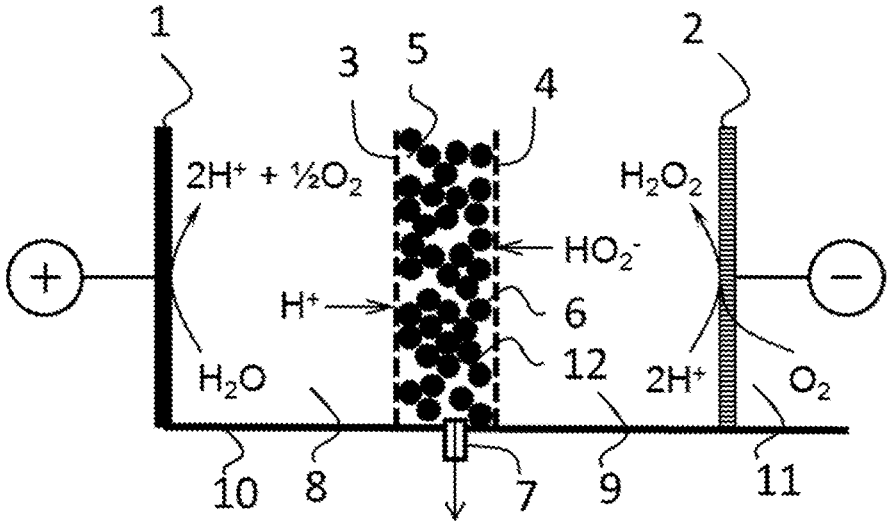

| | | | | |
|---|---|---|---|---|
| 2005/0252786 | A1 | 11/2005 | Dimascio | |
| 2007/0215477 | A1 | 9/2007 | Akahori et al. | |
| 2009/0314652 | A1 | 12/2009 | Buschmann | |
| 2012/0031769 | A1 | 2/2012 | Bhavaraju | |
| 2014/0138256 | A1* | 5/2014 | Deslandes | C25B 9/10 205/556 |
| 2015/0368812 | A1 | 12/2015 | Lee | |

OTHER PUBLICATIONS

Written Opinion, prepared by the European Patent Office, dated Sep. 7, 2017 for International (PCT) Application No. PCT/NL2017/050421 (7 pages).

* cited by examiner

ELECTROCHEMICAL PROCESS AND REACTOR

RELATED APPLICATIONS

This application is a United States National Phase under 35 U.S.C. § 371 of International Application No. PCT/NL2017/050421, filed on 23 Jun. 2017, which claims priority to European Patent Application No. 16176252.1, filed 24 Jun. 2016 and European Patent Application No. 16184995.5, filed 19 Aug. 2016, all of which are hereby incorporated by reference in their entirety for all purposes.

The invention is in the field of electrochemistry and relates to the electrochemical production of compounds in electrochemical cell reactors comprising ion selective membranes. An embodiment relates to the electrochemical production of hydrogen peroxide, in particular from oxygen and water or hydrogen.

Electrochemistry allows for facilitating chemical reactions for producing compounds with electrical energy, for instance from renewable sources. Moreover, electrochemical processes may be particularly suitable for producing chemical compounds on-site and on-demand.

The electrochemical production of hydrogen peroxide is particularly desirable for the decentralized on site production of hydrogen peroxide solutions. These solutions can for example be used for disinfection and/or water treatment, such as in swimming pools. Other applications include bleaching of pulp, paper and textiles and production of chemicals. On site production, i.e. at the site of use, mitigates the need for transport of the hydrogen peroxide solution and on demand or just in time production avoids the need for storage. This would for instance be especially advantageous for use in swimming pools. In addition to disinfection applications, the produced hydrogen peroxide can be used in combination with UV radiation to break down organic compounds (through advanced oxidation), for example to remove drugs, drug residues, and pesticides from aqueous streams, such as in waste water streams in agriculture. This also applies to peroxy compounds such as peracetic acid.

A method for the electrochemical production of hydrogen peroxide is described in EP 2845927. This document describes a process for the electrochemical production of hydrogen peroxide, comprising producing protons at an anode, transporting produced protons through a cation exchange membrane (CEM) into catholyte, producing $HO_{2-}$ anions in a cathode membrane assembly comprising a gas diffusion electrode and an anion exchange membrane (AEM) adjoined to said gas diffusion electrode and in contact with said catholyte. The produced $HO_2^-$ anions migrate at least in part into said catholyte, and are combined with $H^+$ in said catholyte to form $H_2O_2$. In this process, the catholyte or solution in the compartment wherein hydrogen peroxide is formed comprises an electrolyte, in particular a dissolved salt (e.g. 0.5 M $K_2SO_4$) in order to ensure conductivity in the electrochemical cell. Accordingly, the obtained $H_2O_2$ solution contains an electrolyte. For many applications, it would be desirable to directly produce $H_2O_2$ solutions which do not contain electrolytes, or at least may have lower concentrations thereof. If the salt would be omitted from the catholyte in the process of EP 2845927, then the electric resistance would be very high and the power consumption would increase.

A further background reference is U.S. Pat. No. 4,357,217 which describes a method for producing hydrogen peroxide comprising producing $HO_{2-}$ ions within basic aqueous catholyte, producing hydrogen ions ($H^+$) within acidic aqueous anolyte, wherein the hydrogen ions ($H^+$) to move through a cation membrane from the acidic aqueous anolyte to the aqueous solution and the $HO_{2-}$ ions move through the anion membrane from the basic aqueous catholyte to the aqueous solution whereupon said hydrogen ions ($H^+$) react with the $HO_{2-}$ ions to produce hydrogen peroxide within said aqueous solution. In U.S. Pat. No. 4,357,217, the aqueous solution is an electrolyte. Exemplified is 100 ml of 0.1-1 M sulfuric acid solution circulating through the central compartment. Hence, the electrolyte used may affect pH of the product solution obtained.

Yet a further reference is U.S. Pat. No. 7,754,064. The described process is for producing solutions with low concentrations of hydrogen peroxide. In this process, hydrogen peroxide is formed in a catholyte chamber coupled to at least one cathode, resulting in a low hydrogen peroxide concentration. A lower catholyte concentration was said to result in low $H_2O_2$ production.

Yet a further reference is U.S. Pat. No. 6,387,238 disclosing a method for preparing an antimicrobial solution containing peracetic acid, the method comprising: electrolytically generating hydrogen peroxide or peroxide ions; and reacting the hydrogen peroxide or peroxide ions with an acetyl donor to form peracetic acid. By using either a proton permeable membrane or an anion exchange membrane, peracetic acid may be formed in either an alkaline electrolyte in the cathodic chamber or in an acid electrolyte in the anode chamber, respectively.

EP 1103264 describes an electrochemical process for manufacturing a tissue cell growth-promoting solution. The product is obtained from the anode chamber 4. US 2005/252786 describes a three compartment electrolytic reactor 70 for the production of halogen oxide compounds with a central compartment 74 with particles 40. The particles 40 are used for adsorbing alkali metal ions and releasing hydrogen ions. US 2007/215477 describes apparatus for wastewater treatment (e.g. fluoride ion removal). U.S. Pat. No. 6,254,762 to Uno et al. shows in FIG. 2 a three-chamber electrolytic cell for hydrogen peroxide production having two ion-exchange membranes (22, 23) and an intermediate chamber (25) with a ultrapure-water fed opening (30) and a matrix (29) comprising a support of a net structure and an ion-conductive ingredient deposited thereon. A concentration of 1 to 10 000 ppm (1 wt. %) for the produced hydrogen peroxide is given. US 2004/007476 describes an electrochemical method for preparing peroxy acids. The product (peracid) is formed in the cathode compartment.

Accordingly, there is a desire for electrochemical process for the production of compounds in liquids (such as hydrogen peroxide solutions) with lower electrolyte (salt, base and/or acid) concentration.

More generally, it would be desirable to provide electrochemical processes for the production of compounds, such as carboxylic acid and peroxy acids. The compounds are desirably obtained in a liquid which does not contain dissolved salts and/or electrolytic species or desirably low concentrations thereof, and has a desired pH. Good energy efficiency and stable continuous production are furthermore generally desired.

In view of these desires, the present invention provides an electrochemical process for producing a compound, wherein the compound is formed in a compartment of an electrochemical cell, wherein said compartment comprises solid ion-conductive material. The material may serves as electrolyte. The compound can be withdrawn as part of a liquid stream from the compartment. Hence, the solid ion-conductive material is used instead of (at least some) dissolved electrolytic species. In this way, the compartment may for instance be provided with demi water instead of electrolyte solution. The solid ion-conductive material preferably spans substantially or essentially the width (in the direction between two electrodes) of the compartment. The compartment is generally provided with at least one ion selective membrane, and preferably between two ion selective membranes (such as an AEM and CEM, or wherein one membrane is a bipolar membrane BPM). The solid ion-conductive material preferably spans substantially, essentially, or entirely the size of the compartment perpendicular to a membrane. Preferably, at least one of the membranes is used for providing ions into the compartment, such as by transport through the membrane. In some embodiments, ions are formed at or inside a membrane (usually comprising a catalyst) and released into the compartment. The solid ion-conductive material has preferably a construction so as to allow for flow of the liquid stream in a direction parallel to a membrane (or between both membranes).

It has surprisingly been found that these and other desires can be met at least in part by a process wherein ions are combined and/or reacted to form a desired product, such as $H_2O_2$, in a compartment of an electrochemical cell containing a solid ion-conductive material.

Because the product would typically be obtained by withdrawing liquid from the compartment, use of the solid ion-conductive material increases flexibility. The obtained liquid comprising the product can be used more easily because this liquid, as withdrawn from the compartment, can be (substantially) free of electrolyte. The compartment is typically provided between two ion selective membranes, such as an anion exchange membrane (AEM) and a cation exchange membrane (CEM), wherein the CEM or AEM may also be combined into a bipolar membrane (BPM, e.g. AEM+CEM). A bipolar membrane is an ion exchange membrane usually composed of an anion exchange layer and a cation exchange layer. Water electrolysis may occur at a BPM.

Generally, the application also provides an electrochemical process wherein ions are combined and/or reacted with compounds in a compartment between two such membranes, to yield a desired compound, such as a desired organic compound, in particular a carboxylic acid, peroxy carboxylic acid, and/or a peroxy compound, wherein the compartment may contain solid ion-conductive material.

The solid ion-conductive material is additive to, and generally distinct from, the ion selective membranes, such as the AEM and CEM. Preferably, the material is not integral and/or not unitary with the membrane(s) which delimit the compartment, for instance not unitary with the AEM and CEM.

Accordingly, the invention provides a process for the electrochemical production of a compound in an electrochemical cell, the process comprising:

- producing ions at an electrode, preferably in aqueous medium, and optionally reacting the ions with a compound to yield an ionic reaction product,
- transporting said ions or ionic reaction product through an ion selective membrane, preferably an AEM or CEM, into a compartment of the electrochemical cell, wherein the ions or ionic reaction products are at least subjected to a chemical reaction so as to form the compound,
- and obtaining the product, preferably by withdrawing a liquid stream comprising the compound from the compartment, wherein said compartment comprises a solid ion-conductive material.

Preferably, the compartment also comprises water. Preferably, all water is supplied into the compartment through the membranes. Preferably, water molecules migrate with said ions through the membrane, such as the AEM and/or CEM due to electro osmosis drag. Preferably, all water is supplied into the compartment due to this water transport by electro osmosis drag. Preferably, the membrane is impermeable to convective flow of liquids. Preferably, the compartment has no inlet opening for liquids. Preferably, the compound is $H_2O_2$ a solution with a concentration of at least 50 g $H_2O_2$/1 (at least 5 wt. %) or at least 70 g $H_2O_2$/1 (at least 7 wt. %) or at least 100 g $H_2O_2$/1 (at least 10 wt. %) is obtained and withdrawn from the compartment, based on total weight of solution withdrawn from the compartment.

In a preferred embodiment, the invention pertains to a process for the electrochemical production of hydrogen peroxide in an electrochemical cell comprising: producing $H^+$ cations at an anode, producing $HO_2^-$ anions at a cathode, transporting said $H^+$ cations through a cation exchange membrane into a compartment of said electrochemical cell, transporting said $HO_2^-$ anions through an anion exchange membrane into said compartment, wherein hydrogen peroxide is formed in said compartment, and withdrawing a hydrogen peroxide solution with a concentration of at least 50 g $H_2O_2$/1 through an outlet from said compartment, wherein said compartment comprises a solid ion-conductive material, wherein water molecules migrate with said ions through the anion exchange membrane and/or cation exchange membrane due to electro osmosis drag, and wherein all water is supplied into the compartment through the membranes.

Preferably the solid ion-conductive material comprises cation exchange material and/or anion exchange material. Preferably the liquid stream has a conductivity of for example less than 50 mS/cm, even more preferably less than 5 mS/cm. In some embodiments, the conductivity of the liquid stream is less than 50% or less than 10% or less than 1.0% of the conductivity of the anolyte and/or catholyte, in particular as measured on the liquid as withdrawn from the compartment. The product is for example a neutral molecule. Optionally the liquid stream is aqueous and the produced compound is water-soluble. Optionally the liquid in the compartment comprises an organic solvent or organic liquid, such as at least 10 wt. % or at least 30 wt. % or at least 50 wt. % thereof, as measured at the outlet. Optionally the formed product compound is hydrophobic and/or immiscible with water.

The electrochemical process for example involves a chemical reaction to form the product compound, wherein for instance at least a covalent bond is formed and/or involving protonation.

The liquid stream usually withdrawn from the compartment usually has a relatively high concentration of product and the liquid in the compartment can be referred to as "concentrate". The compartment comprising solid ion-conductive material can be referred to as "concentrate compartment". The method may optionally comprise one or more steps of withdrawing the product from the reactor, isolating the product, and/or purifying the product.

In a preferred embodiment, $O_2$ is reduced at a gas diffusion electrode cathode to form $HO_2^-$ wherein said $HO_2^-$ reacts with an organic compound to form an anion in the catholyte, wherein said anion is transported from said catholyte through an anion exchange membrane into the compartment and reacts in said compartment to form the product compound. Preferred as organic compound is for instance an alcohol, especially a $C_1$-$C_{20}$ or a $C_1$-$C_6$ alcohol, such as an aromatic or aliphatic alcohol. Examples include methanol, ethanol, propanol, and butanol.

In preferred embodiment, hydrogen peroxide, peroxide ions (such as $HO_2^-$) and/or peroxide radicals are formed at the cathode, such as by reduction of oxygen, for instance using a gas diffusion electrode, and the formed peroxide species are reacted in situ in the catholyte with a reactant compound, such as an organic compound, for example an alcohol, to form an ionic species, in particular an anion (such as carboxylate). The anion is for example an oxidation product of the reactant compound. The anion is transported through the AEM and reacted, preferably neutralized, in the compartment, thereby forming the product compound in the compartment. In this way, for example carboxylic acid can be produced and withdrawn as product from the compartment.

A further embodiment comprises transporting the $HO_2^-$ anions through the AEM and reacting these anions with a compound in the compartment, e.g. by oxidation of a compound with $HO_2^-$ anions in the compartment. The compound is for example carboxylic acid. The compound may be introduced into the compartment through an inlet opening.

In a preferred embodiment, $HO_2^-$ anions enter said compartment from said catholyte through said anion exchange membrane and react with at least other anions that are transported through said AEM into the compartment, such as said carboxylate anion to form a peroxy carboxylic acid.

Preferably, the process is used for preparing peroxy acids, more preferably peroxy carboxylic acids, more preferably with 2-6 carbon atoms. The process can for instance be used for preparing peracetic acid, perpropionic acid and perbutyric acid. Carboxylic acids, preferably lower aliphatic carboxylic acids, can react with hydrogen peroxide (and/or peroxide anions) in the presence of a catalyst such as (strong) acid (e.g. sulfuric acid) and/or strongly acidic (cation) exchange resin. Such catalyst is preferably present in the electrochemical cell for these embodiments. The preparation of peracetic acid is particularly preferred. Peracetic acid may for example be used for disinfection and for its antimicrobial effect.

Figure 5:
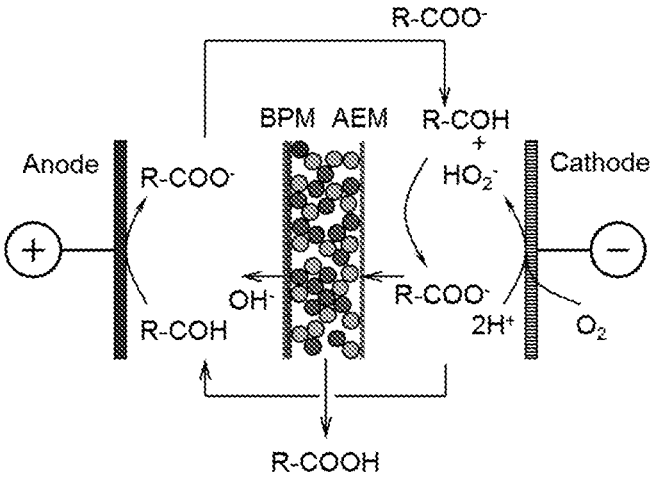
Figure 7:
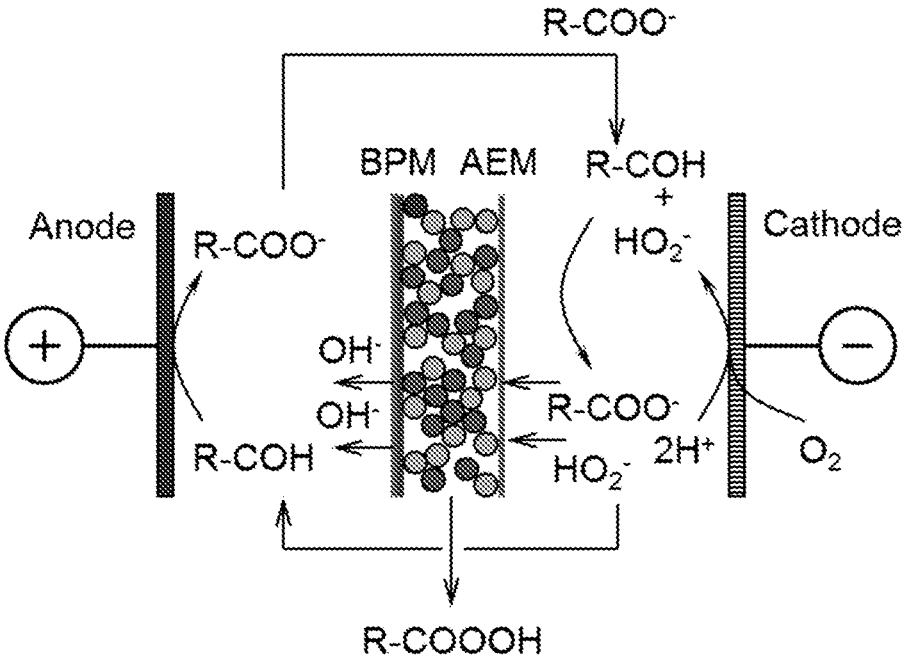

In a preferred process, a (preferably organic) compound is oxidized at the anode to give an anion, the process further comprises circulating anolyte comprising said anion into the catholyte compartment, thereby allowing for transporting the anions through the anion exchange membrane into the compartment comprising solid ion-conductive material. This feature can be used for instance for the production of carboxylic acids and peroxy carboxylic acids. Illustrative embodiments are shown in FIGS. 5 and 7. For this embodiment typically a BPM is used.

Yet a further option is a process wherein anode material is applied on the CEM, such as by applying catalyst particles, for instance iridium oxide catalyst particles, on the CEM. This may provide for increased flexibility of the pH of the anolyte and the compartment.

The invention also provides for the use of solid ion-conductive material, preferably an ion exchange material, as at least partial electrolyte replacement in an electrochemical process for preparing a compound. The use is preferably for replacing at least partially dissolved electrolytic species (e.g. dissolved ions).

Preferably, the ion exchange material is provided in a compartment of an electrochemical cell wherein said compound is formed. Preferably, the ion exchange material is provided between two ion selective membranes. Preferably the material allows for flow of a liquid for withdrawing the produced compound from the compartment. For example the membranes form a stack with the material.

The solid ion conductive material may for instance be used for achieving a that the obtained liquid comprising the product has a conductivity of less than 50 mS/cm, more preferably less than 10 mS/cm, even more preferably less than 5 mS/cm or less than 1.0 mS/cm, for instance as obtained at the outlet of the electrochemical cell.

Generally, the invention relates to use of solid ion-conductive material for providing ionic species into a compartment of an electrochemical cell, preferably in a process for electrochemically producing products, wherein the product compound is formed and/or obtained (such as by a chemical reaction and/or the combination of ionic species) in said compartment wherein said solid ion-conductive material is present. The compartment preferably is separated by at least one ion selective membrane from another compartment of the electrochemical cell, and is preferably provided between two ion selective membranes, such as an AEM and CEM, and optionally no electrode is provided in said compartment.

Furthermore, the invention pertains in a preferred embodiment to a process for the electrochemical production of hydrogen peroxide, the process comprising producing $H^+$ cations at an anode, producing $HO_2^-$ anions at a cathode, transporting said $H^+$ cations through a cation exchange membrane into a compartment, transporting said $HO_2^-$ anions through an anion exchange membrane into said compartment, wherein hydrogen peroxide is formed in said compartment, and withdrawing a hydrogen peroxide solution from said compartment, wherein said compartment comprises a solid ion-conductive material.

The invention also pertains to a reactor comprising an electrochemical cell comprising an anode, a cathode, and at least two ion selective membranes defining a compartment between them having an outlet, wherein at least one of said membrane is arranged for transport of ionic species into said compartment, the compartment comprising the solid ion conductive material, wherein said material is preferably an ion exchange material and preferably has channels allowing for flow of liquid through said solid ion-conductive material to said outlet. This allows for withdrawing a liquid stream comprising product from said compartment. The compartment is for instance provided between two neighbouring membranes, for instance between two adjacent membranes, preferably such that no further membranes dividing the electrochemical cell into compartments are present in said compartment, and/or preferably such that liquid convective flow (also with any ionic species) is present between said membranes. Preferably, the compartment is arranged such that with no electric current applied (the reactor turned off), any liquid composition in the compartment has (essentially) homogeneous composition in equilibrium.

A preferred reactor is a reactor comprising an electrochemical cell comprising an anode, a cathode (preferably comprises a gas diffusion electrode), a cation exchange membrane and an anion exchange membrane, preferably wherein said anion exchange membrane is adjoined to said cathode or defines a catholyte compartment with said cathode, and a compartment between said cation exchange membrane and said anion exchange membrane, wherein said compartment between said membranes comprises an outlet for a liquid stream, preferably formed hydrogen peroxide solution, and wherein the compartment contains a solid ion-conductive material, preferably an ion exchange material, and having channels allowing for flow of liquid through said solid ion-conductive material to said outlet.

The compartment comprises a solid ion-conductive material. In a preferred embodiment, the compartment comprises a fixed packed bed comprising cation exchange resin beads and/or anion exchange resin beads, such as a bed comprising cation exchange resin beads, optionally together with anion exchange resin beads. The anion exchange resin beads and the cation exchange resin beads are preferably mixed with each other. They can for example also be applied in layers. In operation, the packed bed of resin beads generally stays in the compartment. The bed is a packed bed but contains a void fraction, which in operation allows for outflow of a product containing liquid stream, such as hydrogen peroxide solution to an outlet of the compartment. Alternative solid ion-conductive materials include, for example, ion exchange spacers and structured ion exchange membranes.

Without wishing to be bound by way of theory, the solid ion-conductive material may facilitate transport of ionic species in the material. The solid ion-conductive material may comprise ionic or ionogenic groups. For example formed cations, such as $H^+$ cations, which permeate through the CEM may further migrate through the solid ion-conductive material by hopping by virtue of anionic groups in the material. Optionally, formed anions, such as $HO_2^-$ anions, may migrate through solid ion-conductive material by hopping by virtue of cationic groups in the solid material. Protons may recombine with $HO_2^-$ anions for instance at the surface of the solid material, such as particles or beads at the interface with a liquid, (with either ion in solution), or for example at an interface between an anion and a cation exchange solid material, to form hydrogen peroxide. The hydrogen peroxide is released into a liquid phase flowing through the material. The hydrogen peroxide may also form in solution. This applies similarly to anions and cations (e.g. $H^+$) in general that can combine with each other and/or react with compounds (in particular compounds in the liquid phase) at such surface. Yet a further advantage of the solid material is that immobilized ionic species are provided in said compartment. Hence, in an aspect, the solution is for example salinated, salted or provided with ionic groups by virtue of the solid material.

Preferably, a solution with a concentration of at least 10 g $H_2O_2$/1 or at least 50 g $H_2O_2$/1 or at least 70 g $H_2O_2$/1 or at least 100 g $H_2O_2$/1 is obtained (based on total weight of solution withdrawn from the compartment).

Preferably, the solution obtained at an outlet of the compartment comprises at least 99 wt. %, or at least 99.9 wt. %, or at least 99.99 wt. % water and hydrogen peroxide, together, preferably with at least 70 g $H_2O_2$/1 or at least 100 g $H_2O_2$/1. Preferably, the liquid stream (for example comprising the organic product compound or the $H_2O_2$ solution) has a conductivity of less than 50 mS/cm, more preferably less than 10 mS/cm, even more preferably less than 5 mS/cm or less than 1.0 mS/cm, for instance as obtained at the outlet of the electrochemical cell. With optimization, the liquid may achieve a conductivity of less than 500 μS/cm, or less than 100 μS/cm or even less than 10 μS/cm, or less than 2 μS/cm The compartment may comprise one or more types of solid ion-conductive material. The term "ion-conductive material" is used as including, preferably, any material which is permeable to at least one kind of ions, more preferably is selectively permeable to either anions or cations. Preferably, said material is permeable for anions and not for cations, or is permeable for cations and not for anions. The solid material is usually an insulator for electrons. Preferably, the solid material is a polymer electrolyte material. Preferably, the material is polymeric. Preferably, the material is an ion exchange material, such as a cation and/or anion exchange material, more preferably an ion exchange resin. Preferably, the compartment comprises a cation exchange material. Optionally, the compartment comprises an anion exchange material. For example, the material is a solid polymer electrolyte.

Solid polymer electrolytes as used in e.g. fuel cells generally do not have channels for flow of solution to an outlet. Ion permeable membranes are generally used to separate charged species from uncharged species. Accordingly, the solid ion-conductive material is arranged and used in a rather different way in the present invention.

Optionally, the material comprises an ionomer. An ionomer is for example a polymer that comprises constitutional units (monomer residues) comprising ionisable and/or ionic moieties, preferably as pendant group moieties, preferably for less than 20 mole percent based on total number of constitutional units.

Optionally, said cation exchange material comprises sulfonic acid or carboxylic acid functional groups attached to or incorporated in a resin matrix, including their salt forms. Preferably, said cation exchange material comprises a polymer comprising constitutional units having pendant carboxylic acid and/or carboxylate groups and/or pendant sulfonic acid and/or sulfonate groups.

Optionally, the anion exchange material comprises a polymer comprising quaternary primary, secondary, and/or tertiary amino groups, preferably as pendent groups. Preferably, the material comprises a polymer comprising constitutional units comprising said groups, more preferably quaternary amino groups. In view of the pH in the compartment, quaternary ammonium groups and sulfonic acid groups are preferred as ion exchange groups.

The solid material preferably comprises a water-insoluble cross-linked polymer, such as a cross-linked styrene copolymer, in particular crosslinked styrene divinyl benzene polymeric resins, having said groups. Acrylic and methacrylic resins may also be used, as well as polyalkylamine, polyolefins, and phenolic resins. Also possible are perfluorinated polymers, in particular with sulfonyl-containing comonomers. In particular Nafion® PFSA Superacid Resins NR-40 and NR-50 can be used. These are a bead-form, strongly acidic resin. It is a copolymer of tetrafluoroethylene and perfluoro-3,6-dioxa-4-methyl-7-octenesulfonyl fluoride, converted to the proton form.

The compartment generally comprises one or more outlets and/or inlets, in particular outlet openings for a stream comprising the product, preferably a liquid stream, such as hydrogen peroxide solution. The outlet and/or inlet is for example provided in the casing, such as at a side (including top or bottom) of the compartment, between the cation exchange membrane and the anion exchange membrane. The one or more outlets and/or inlets may also be provided by one or more openings in one or more membranes, which are suitably provided with a flow connection at the other side of the membrane, for instance for flow of fluids to and from the compartment separate from anolyte and/or catholyte.

The solid (ion-conductive) material in the compartment is preferably configured for flow of liquid from throughout the compartment (i.e. any location in the compartment) to the outlet or to at least one of the outlets, wherein said flow is by convective flow, e.g. by gravity or a pressure difference. Preferably, the solid (ion-conductive) material is a flow-through ion exchange material configured for flow of a liquid through the material. Preferably, the solid material comprises passageways or channels allowing for flow of a liquid through them. The channels are essentially open spaces and may include, for example, pores, ducts and voids. Examples of channels include macropores of a foam, interstitial voids in a particle bed, ducts in a monolith and open space in a spacer.

Preferably, said channels comprise channels extending in a direction parallel to the membranes. In case of an outlet at the top or bottom, the channels more preferably extend in the vertical direction. Preferably, the solid material allows for flow of liquid in the vertical direction in such case. More preferably, the material allows for flow of a liquid stream from said outlet throughout the compartment and throughout the solid material. Preferably, at least 50% or at least 90% of the surface of a side of the solid material facing a membrane is in fluid connection with an outlet of the compartment for hydrogen peroxide solution through said solid material.

For example a packed bed of particles can be used, having a void fraction between the particles of at least 5 vol. %, or at least 10 vol. %, or at least 20 vol. %, preferably provided by interstitial voids between particles. The packed bed preferably essentially consists of particles, such as beads, having a particle size of 100 μm or more, or at least 0.5 mm, or at least 1.0 mm. Preferably, the outlet has a screen for filtering the particles.

The solid ion-conductive material may be provided into the compartment for example by a slurry of ion exchange resin particles introduced into pre-formed compartments. In an alternative approach, ion exchange resin may be adhered to a spacer sheet. Furthermore, resin beads can be provided within a spacer envelope positioned between the membranes as the compartment is formed.

Preferably, a bed is used comprising cation exchange resin beads and/or anion exchange resin beads. In case of both anion and cation exchange resin beads, the resin beads can be mixed or are for example applied as horizontal layers in the bed. Preferably the bed is fixed and immobile during operation. Preferably, in the bed, beads of the same type are in communication in series (i.e. in contact) with each other so as to promote ion transfer. Also possible are beads comprising both anion and cation exchange resin in a single bead.

If for example a monolithic solid material is used, this material is preferably provided with channels, preferably throughout the solid material, and preferably having a channel diameter of at least 0.10 mm or at least 1 mm (e.g. based on equivalent surface area). An example is an ion exchange membrane provided with channels, in particular channels in the plane of the membrane. As a further example, ion exchange gels can be shaped by molding. In case of an outlet at the bottom or top of the reactor, vertical channels may be provided in a molded monolithic ion exchange material structure, preferably with interconnected channels.

Yet a further option is using a spacer comprising an ion exchange material. Spacers typically comprise a woven or non-woven fabric, including a mesh, web, net or screen. The spacer can for example comprise, in particular be made of, fibers having ion exchange functionality, such as fibers comprising or consisting of ion exchange resin. The fibers can be combined with or without binder into a spacer. The binder optionally forms a matrix. Optionally, a polyolefin spacer is provided with ion-conduction functionality by radiation-induced graft polymerization to introduce ion exchange groups. Coated fibers with ion exchange coatings could also be used. Preferably, a cation exchange resin spacer is in close contact with the CEM and preferably an anion exchange resin spacer is in close contact with the AEM, such that ions can smoothly transfer from membrane into spacer. The same applies for other materials such as beads. In yet a further option, ribs or strips of ion exchange membranes can be arranged, such as woven, to provide for a multilayer spacer.

Yet a further option is using structured ion exchange membranes as solid ion-conductive material, for example membranes provided with ribbons and/or grooves or channels, typically parallel (e.g. having a length in or parallel to the membrane plane). Less preferred are grooves and channels through the membrane. Channels preferably a diameter of at least 0.10 mm or at least 0.50 mm.

Also possible is an ion exchange foam, preferably with an open cell structure. For example a polyurethane foam with open cell structure may be grafted with styrene and sulfonated. Ion exchange groups may be introduced onto phenol-formaldehyde polymers, styrene-grafted polyurethane and polyethylene foams by for example sulfonation, chloromehtylation and amination.

These various shapes of the solid ion-conductive material may also be combined. Hence, the compartment may for instance comprise one or two or more selected from the group consisting of beads, spacers, foams, monolithic material and structured membranes comprising ion exchange material.

Preferably, at least one of said anion and cation exchange membrane, is in contact with (at least part of) said solid ion-conductive material, preferably both. Optionally the AEM and/or CEM is in contact with a packed bed of the one or more solid materials or a spacer, more in particular in contact with a packed bed of ion exchange resin beads.

Further suitable solid ion-conductive materials are for instance those used in electro deionization in the feed channel for capturing ions from a feed stream.

The process is carried out in a reactor comprising an electrochemical cell comprising two electrodes and a casing, for example a container. Usually the reactor comprises a CEM and an AEM, and a compartment between the CEM and AEM comprising solid ion-conductive material. The compartment between AEM and CEM is usually further defined, in particular at the edges, by a part of the casing. The reactor further comprises an external power supply and electrical lines for connecting the electrodes to the external power supply. A reactor may comprise multiple cells, wherein the reactor can be constructed for monopolar or bipolar operation. For monopolar operation, each electrode is separately connected to a power supply. For bipolar operation, only the two outer electrodes are connected to the power supply. The inner cathodes and anodes are connected with each other forming one electrode which operates at one side as cathode and at the other side as anode. The invention also pertains in an aspect to such reactor.

Optionally, the reactor comprises between an anode and a cathode not more than one AEM and not more than one CEM. Between the CEM and the cathode, the AEM is preferably positioned. Between the AEM and the anode, the CEM is preferably positioned. A CEM is preferably provided adjacent to the anode or defines a compartment with the anode. An AEM is preferably provided adjacent to the cathode or defines a compartment with the cathode. This preferred arrangement is different from that used for electro deionization. It allows for transporting ions into the compartment.

The anode, cathode and membranes may for example be provided in a planar arrangement, such as in an essentially parallel plate arrangement, or in a concentric arrangement, such as in a circular configuration, or in a spirally wound configuration. The AEM and CEM are preferably spaced from each other, preferably by at least 0.50 mm, or at least 1 mm, or at least 2 mm, or at least 5 mm, or at least 10 mm, and/or less than 5 cm or less than 10 mm or less than 5 mm. This provides a dimension of the compartment. Such separation is advantageous in order to enclose the solid material and also to enable liquid flow with small pressure drop.

The anode is for example a dimensionally stable anode, such as an anode comprising an iridium oxide coating, ruthenium oxide coating or platinum oxide coating, for example on a titanium (oxide) substrate element. Suitable forms for the anode and/or cathode are for example plate, mesh, rod, wire and ribbon. The electrodes and membranes, including the gas diffusion electrode (GDE), AEM, and/or CEM preferably have a relatively small thickness compared to their length and width and preferably have a sheet-like or plate-like shape which can be for example flat, curved, rolled or tubular.

Also possible is using a NiOOH (Nickel oxyhydroxide) as anode. Also possible is using a bipolar membrane instead of a CEM. In such a case, circulation of anolyte to the catholyte is an option.

The process preferably uses an AEM and CEM as selective ion-permeable membranes. The membranes are generally polymeric. The AEM typically comprises fixed cationic groups and allows for passage of anions and blocks cations. The CEM typically comprises fixed anionic groups and allows for passage of cations while blocking anions. The CEM for example comprises a polymer with fixed negatively charged groups, for example but not restricted to $SO_3^-$, $COO^-$, $PO_3^-$ or $HPO_3^-$, salts and acids thereof. Such a cation exchange membrane selectively permits the transfer of positively charged cations, such as protons, such as from anolyte into an adjacent compartment. Suitable cation exchange membranes include for example membranes based on perfluorosulfonic acid, in particular comprising perfluorosulfonic acid/PTFE copolymer in acid form. Preferred are polymers comprising perfluorovinyl ether groups terminated with sulfonate groups incorporated onto a tetrafluoroethylene backbone, for example the various Nafion® membranes available from DuPont (sulfonated tetrafluoroethylene based fluoropolymer-copolymer membranes), such as N112, N115 and N117. Other suitable membranes are for example CM1, CM2, CMB, CMS, CMX and CMXSB available from Eurodia and/or Astom Corporation.

Preferably, the anionic exchange membrane comprises a polymeric membrane comprising fixed positively charged groups, such as for example $RH_2N^+$, $R_2HN^+$, $R_3N^+$, $R_3P^+$, $R_2S^+$. These groups can be covalently bonded to a polymer backbone. The anionic exchange membrane is preferably base resistant. Suitable exchange groups include tetraalkyl ammonium groups with a polyolefin backbone chain. Suitable anion exchange membranes include for example the Tokuyama Neosepta, AHA, ACM, ACS, AFX, AM1, AM3, AMX membranes, also available from Astom Corporation, Japan and Eurodia, France) and the FAA, FAB, FAD, FAS and FTAM membranes available from Fumatech. An AHA membrane, available from Eurodia and Astom, is preferred in view of its chemical stability. Also suitable is a membrane with quaternary ammonium exchange groups on cross-linked fluorinated polymer, e.g. Morgane® ADP membrane from Solvay; or a perfluoro-anionic exchange membrane such as Tosflex® from Tosoh Co (Japan).

Preferably, the anion exchange membrane has a selectivity of 0.9 or more, more preferably 0.95 or more, even more preferably 0.98 or more. Anion exchange membranes with such selectivity are commercially available, for example the AHA membrane available from Eurodia and Astom. The membranes are for example less than 1 mm thick or less than 0.50 mm, and are for example provided with fiber reinforcement.

The cathode is typically a gas diffusion electrode (GDE). For a GDE, the reactor preferably comprises a compartment at the gas side of the GDE. Preferably, the reactor comprises an inlet for supplying oxygen-containing gas to a GDE cathode.

A GDE is porous, permeable for gases such as air, and electrically conductive. In operation, the GDE preferably provides a conjunction of a solid, liquid and gaseous phase. Optionally, the GDE is in liquid contact with electrolyte in the process. The GDE preferably comprises carbon, a hydrophobic binder and a catalyst. A suitable hydrophobic binder is for example PTFE (polytetrafluoroethylene). Suitable catalyst materials for the cathode include, for example, metals, metal alloys, metal oxides, metal complexes, and organic compounds, such as tin-nickel, cerium oxide, cobalt (II) phthalocyanine, cobalt, several carbon compounds, platinum, platinum alloys, alkyl-anthraquinone, catechol-modified chitosan, vanadium, gold, gold alloys or iron (II) phthalocyanine The catalyst is preferably in the form of small particles, for example with volume average particle size smaller than 5 μm. The cathode is preferably configured for two electron reduction of $O_2$.

The GDE preferably comprises a current collector such as a metal mesh, for example nickel, gold-plated nickel wire mesh or stainless steel wire mesh, or carbon paper or carbon fleece. The current collector preferably is positioned at the oxygen gas stream side of the gas diffusion electrode cathode. Other types of electrodes suitable for hydrogen peroxide production include carbon plates, optionally with an anion exchange membrane placed onto it, reticulated vitreous carbon (RVC), carbon particles and carbon cloth.

Optionally, the AEM and cathode are spaced apart and a catholyte compartment is provided between them such that the AEM is in liquid contact with the cathode. Optionally, such a catholyte compartment comprises an inlet and/or outlet for liquids. In some embodiments, the catholyte compartment does not contain an outlet, and optionally neither an inlet, for a liquid stream. Alternatively, the AEM and cathode, in particular GDE, can be adjoined to each other and form a Membrane Electrode Assembly (MEA). Optionally, the anode is a gas diffusion electrode, allowing for withdrawal of formed oxygen from the oxidation of water to the gas side, or for using hydrogen at the gas side. Optionally, the reactor comprises a compartment at the gas side of the anode GDE with an inlet and/or outlet for supply of $H_2$ or withdrawal of $O_2$. Optionally the CEM and GDE anode form a Membrane Electrode Assembly.

In a Membrane-GDE Assembly, the GDE and CEM or AEM are adjoined to each other. Preferably, they are attached face-to-face to each other, more preferably adjoined. Accordingly, the GDE and membrane preferably both have a sheet-like or plate-like shape. Preferably, GDE and membrane are adjoined at a side surface of each, as opposed to at an edge. Preferably, the GDE and membrane are in contact, preferably in touching contact, with each other over at least 90% by area of a side of each, more preferably over 95% or more. This contact between GDE and membrane provides the advantage that the assembly can act as a single structural unit of the reactor. The assembly accordingly preferably forms an integrated structure. In this way, the GDE and membrane are preferably stacked on each other to form a multilayer structure of generally parallel layers, one layer comprising or formed by a gas diffusion electrode and a next layer comprising or formed by the ion exchange membrane. The membrane preferably covers at least one surface of the GDE completely, such as 95-100% by area. The GDE and membrane can for example be clamped, pressed, adhered and/or glued to each other. The membrane can also be directly formed on the GDE, for example by casting of the membrane on the GDE or by incorporating ion exchange particles into a top layer of a GDE which faces electrolyte. The GDE can also be formed on the membrane. The assembly may comprise one or more elements that attach the membrane and the GDE to each other, such as one or more clamps and/or adhesive. Another way of assuring good contact between the membrane and the GDE is by applying a higher pressure at the electrolyte side thus pressing the membrane onto the GDE, e.g. in operation. The assembly can optionally comprise a very thin liquid layer at the interface of the GDE and the membrane, having a thickness of less than 0.1 mm, more preferably less than 50 μm, even more preferably less than 1 μm. The optional very thin liquid layer can also be absent.

FIG. 1 schematically depicts a non-limiting example of the invention.

The electrochemical cell reactor comprises an anode (1), a gas diffusion electrode (GDE) as cathode (2), a cation exchange membrane (3) and an anion exchange membrane (4) defining a compartment (5) between them. The compartment (5) comprises a solid ion-conductive material (6) and an outlet (7) for formed hydrogen peroxide solution. The reactor further comprises a casing shown in part as bottom (10) wherein outlet (7) for hydrogen peroxide solution of compartment (5) is provided. An anolyte compartment (8) is provided between the anode (1) and CEM (3). The AEM (4) and the cathode (2) define a catholyte compartment (9) between them. By virtue of AEM (4), high pH in the catholyte compartment (9) can be maintained, enabling the formation of $HO_2^-$ ions.

In FIG. 1, the solid ion-conductive material (6) is provided as a resin beads (12), more in particular as a packed bed of resin particles. The reactor further comprises a compartment (11) at the gas side of the cathode (2) for supply of oxygen containing gas such as air. Optionally, compartment (5) also comprises an inlet for a liquid (not shown), usually in the casing at a side opposite of outlet (7).

The pH in the anolyte compartment (8) is typically lower than 5 or lower than 3. The pH in compartment 5 is for instance lower than 8 or lower than 7, for example in the range of 3 to 8 or 4 to 7. Also in case AEM (4) is attached to the cathode (2), the liquid in compartment 5 can have a pH of lower than 8 or lower than 7, for example in the range of 3 to 8 or 4 to 7. The pH in the catholyte compartment (9) is preferably higher than 8, more preferably higher than 10, for example the catholyte has a pH between 12 and 14.

FIG. 1 is schematic, in practice the compartments (5, 8, 9) could be defined by frames between membranes. Optionally, said anolyte compartment (8) and/or catholyte compartment (9) are also provided with solid ion-conductive material.

Figure 2:
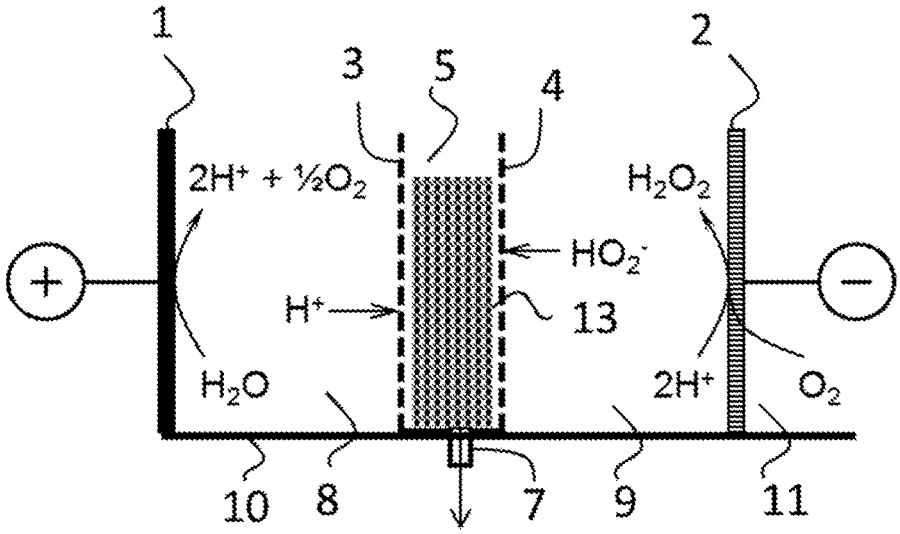

In FIG. 2, the solid ion-conductive material (6) is provided as a spacer (13) of cation-ion exchange material which spaces the CEM (3) and AEM (4) form each other.

Figure 3:
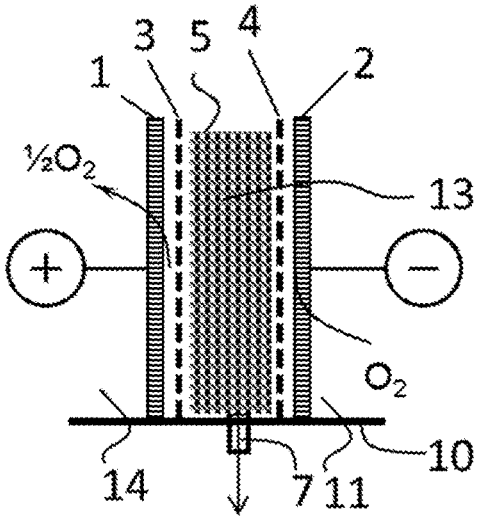

In FIG. 3, anode (1) is a gas diffusion electrode. Moreover, AEM (4) is adjoined to cathode (2) to form a MEA. AEM (4) and cathode (2) are in touching contact (for the purpose of clarity of the drawing, a small gap is shown in the figure). Similarly, anode (1) is adjoined to CEM (3) to form a GDE-Membrane Assembly. Further, the reactor comprises a compartment (14) for withdrawal of oxygen gas or for supply of $H_2$ (not shown). This embodiment could be stackable if a bipolar electrode configuration is used. The pH in compartment 5 is lower than 8 or lower than 7, for example in the range of 3 to 8 or 4 to 7.

Furthermore, other compartments than the compartment between CEM and AEM may comprise solid ion-conductive material as well, such as the anolyte and/or catholyte compartments.

The process can be a batch process or a continuous process. The electrochemical process preferably comprises applying a direct electric current (DC) to the electrodes to drive chemical reactions by externally applying a voltage. Preferably, the process comprises applying electric current (DC) at 100 $A/m^2$ or more, more preferably 250 $A/m^2$, even more preferably 500 $A/m^2$ or more, typically less than 4000 $A/m^2$. The process is for instance carried out at about ambient pressure, or for instance at a pressure in the range of 1.1 to 3 bar.

In this way, in an embodiment, the method comprises as active step applying an electric current to the electrodes. Preferably such that $H^+$ ions are produced at the anode and migrate to the cathode, thereby permeating through the CEM, and $HO_2^-$ anions are produced at the cathode and migrate to the anode, thereby permeating through the AEM, and the $H^+$ and $HO_2^-$ ions combine to form $H_2O_2$ in the compartment between AEM and CEM. $HO_2^-$ anions are produced at the cathode by the two-electron reduction of oxygen at basic pH. Water molecules migrate with $H^+$ ions and/or $HO_2^-$ ions through the AEM and/or CEM, for example due to electro osmosis drag. At the anode, oxygen is for example produced. Compounds other than oxygen (and $H^+$ ions) can be produced as well. The reaction at the anode may for instance involve oxidation to yield peroxy acids, ions and/or salts thereof, such as oxidation of sulphate to persulphate.

Also possible is oxidation of organic compounds at the anode, for instance with hydrogen peroxide as product compound of the process or another product. An example is oxidation of alcohols, in particular primary alcohols, under formation of carboxylate at the anode, in particular with a NiOOH anode. The anolyte can be circulated to the catholyte compartment.

Preferably, the process comprising supplying an oxygen-containing gas, such as air, oxygen-enriched air (22 to 50 vol. % oxygen) or oxygen (e.g. more than 90 or more than 99 vol. % oxygen) to the gas side of a GDE cathode.

In the process, makeup water is supplied into the cell because of water transport to the middle compartment. Optionally a limited amount of base and/or acid is added to account for the non-ideal nature of membranes, e.g. less than 10 mmol or less than 1 mmol or less than 10 μmol acid and/or base per mol hydrogen peroxide formed.

In a preferred embodiment, hydroperoxide anions ($HO_2^-$) and protons ($H^+$) combine in the compartment to form hydrogen peroxide ($H_2O_2$). A solution with high concentration of hydrogen peroxide can be formed in the compartment between the membranes. Because the hydrogen peroxide is formed in the compartment and hence isolated and separated from the anode and from the cathode, a greater concentration of hydrogen peroxide is possible, such as 70 g/l or more. This advantage also applies for other compounds.

The invention also relates to use of a solid ion-conductive material in an electrochemical process for the production of compounds, such as hydrogen peroxide, for facilitating combination cations and/or anions with each other and/or other compounds, for instance of $H^+$ cations and $HO_2^-$ anions, preferably having the mentioned features. The invention also relates to an electrochemical cell reactor comprising an anode and cathode and AEM and/or CEM, wherein at least one compartment comprises an ion-conductive solid material, preferably having the described features, and to a process for the electrochemical production of compounds, such as hydrogen peroxide, using such reactor.

The formed hydrogen peroxide is for example used for disinfection, for instance of an object, surface, or liquid. Preferably the hydrogen peroxide is used for treatment of swimming pool water. Preferably, the outlet of the reactor is in liquid connection with a liquid stream or liquid to be treated, such as swimming pool water. The outlet is hence preferably provided with a liquid flow connection for dispensing the solution in a swimming pool. The invention also relates to a swimming pool system comprising a swimming pool containing water and the reactor, wherein the outlet of the reactor is in liquid communication with the swimming pool. In the process, the hydrogen peroxide solution is optionally dispensed into a liquid stream or liquid to be treated, for instance comprising a contamination, directly or through a liquid connection line. Optionally, the hydrogen peroxide is used in a method of treating liquids, such as sprays, aerosols, solutions, suspensions, foams and emulsions. Optionally, the liquid is a liquid to which humans, animals, plants and/or living material such as cultured cells and tissues are contacted or exposed. Optionally, the hydrogen peroxide is used as bleaching agent for the paper, pulp and textile. Optionally, the hydrogen peroxide is used as chemical reagent for the synthesis of chemical compounds. Optionally, the hydrogen peroxide is used for disinfection of swimming pool water and water for showers, baths, toilets, whirlpools and saunas. The disinfection may comprise deactivating and/or killing microorganisms and pathogens, and preferably comprises reducing or inhibiting micro-organism growth, for example bacterial growth. This also applies for other peroxy compounds.

The process may further comprise a step of a treatment of water, a fluid, an object or a surface, comprising reducing the concentration of contaminants in the water, fluid, or on the object or the surface, such as by oxidising the contaminants with the formed hydrogen peroxide. Preferably halogenated compounds as contaminants are oxidized. Preferably the process comprises treating a waste water stream with the hydrogen peroxide, for instance to oxidize such contaminants, in particular hydrofluorocarbon compounds.

Preferably, the hydrogen peroxide is formed and used on site, for example in the same plant or building, or for example in a range of 5 km or less or 1 km or less or 100 m or less. Hence, the hydrogen peroxide is preferably used and consumed in the same plant or building or at such distance from the electrochemical reactor wherein it is produced according to the invention. Optionally, the formed hydrogen peroxide is used in less than 3 days after the production, or in less than 1 day, or within 1 hour, or within 10 minutes. Optionally, the reactor comprises less than 10 L, or less than 1 L, or less than 100 mL of hydrogen peroxide containing solution.

Optionally, the rate of the production is continuously, or at regular intervals, adjusted by adjusting the electric current, depending on the demand for hydrogen peroxide. Optionally, a liquid stream to be treated, such as swimming pool water, is passed through a compartment comprising the solid ion-conductive material. In an alternative embodiment, the compartment does not have an inlet for liquid and no liquid is introduced into it. All water may be supplied into the compartment through the membranes.

The method can further comprise UV-light exposure and/or activation of the hydrogen peroxide by a catalyst e.g. a transition metal catalyst. UV-light exposure is preferred in view of avoiding contamination.

Figure 4:
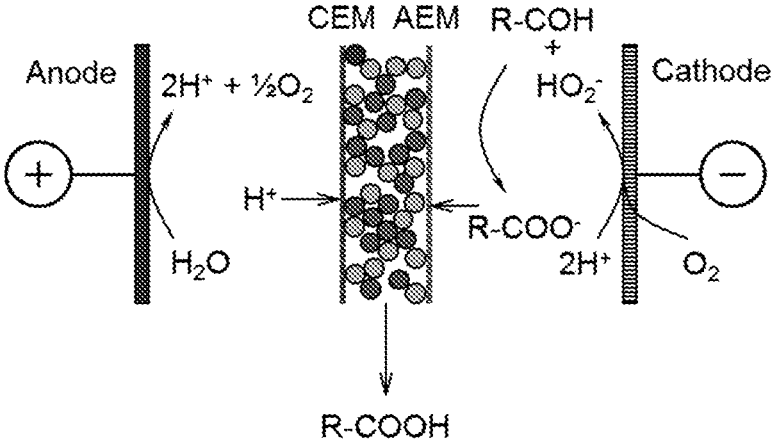

FIG. 4 shows a process for producing carboxylic acids. Hydrogen peroxide is formed at the GDE cathode by oxygen reduction, and reacts in catholyte with a primary alcohol to give carboxylate. The carboxylate is transported through the AEM into the compartment comprising two types of resin beads, cation exchange beads and anion exchange beads. The carboxylate is neutralized with $H^+$ from the anode passing through the CEM into the compartment to form carboxylic acid, which is obtained by withdrawing liquid from the compartment. No dissolved electrolyte is necessary in the compartment.

FIG. 5 illustrates another process for producing carboxylic acid. Instead of CEM, a bipolar membrane BPM is used. An alcohol is oxidized at the anode (in particular a NiOOH anode) to give carboxylate anions, the liquid is circulated into the cathode compartment. In the cathode compartment, alcohol may also react with peroxide anions formed at the cathode. The formed carboxylate anions pass through the AEM into the compartment (filled with e.g. demi water i.e. demineralized water) where they can be protonated to give carboxylic acid. Liquid from the catholyte compartment is also supplied back to the anolyte compartment.

Figure 6:
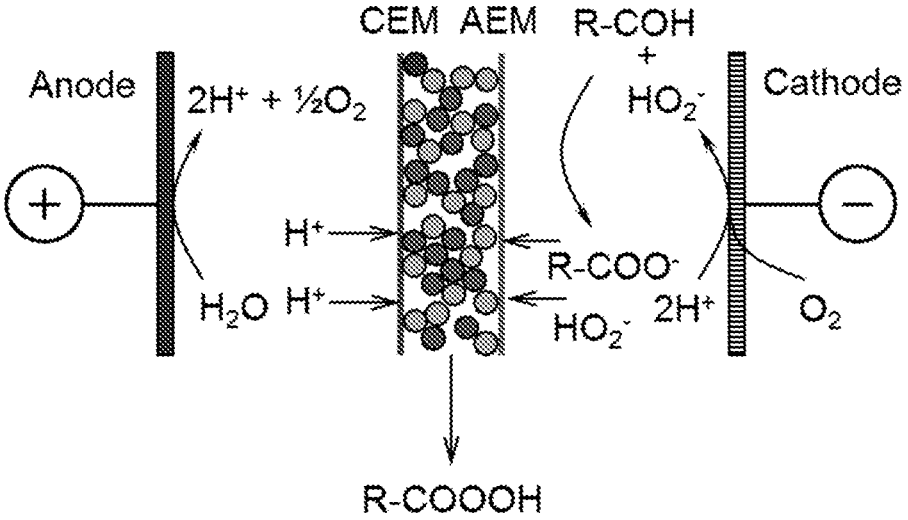

FIG. 6 illustrates a process for preparing peroxycarboxylic acid. A (primary) alcohol reacts with $HO_2^-$ anions formed at the cathode to give carboxylate anions which pass through the AEM into the compartment, as well as $HO_2^-$ anions. $H^+$ passes through the CEM into the compartment. Peroxycarboxylic acid (organic peracid) is formed in the compartment and withdrawn. Organic peroxyacids (e.g. peroxycarboxylic acid) can be generated by treating the carboxylic acid with hydrogen peroxide.

FIG. 7 illustrates a process for preparing peroxy carboxylic acids using a BPM. Carboxylate anions are produced by alcohol oxidation at the anode and circulated into the catholyte compartment, from where the carboxylate anions enter the compartment through the AEM. Also in this embodiment, the compartment contains a bed of two types of resin beads, cation exchange resin and anion exchange resin. The compartment further contains e.g. demiwater. Peroxy carboxylic acid, such as peracetic acid, is withdrawn in an aqueous stream from the compartment.

Figure 8:
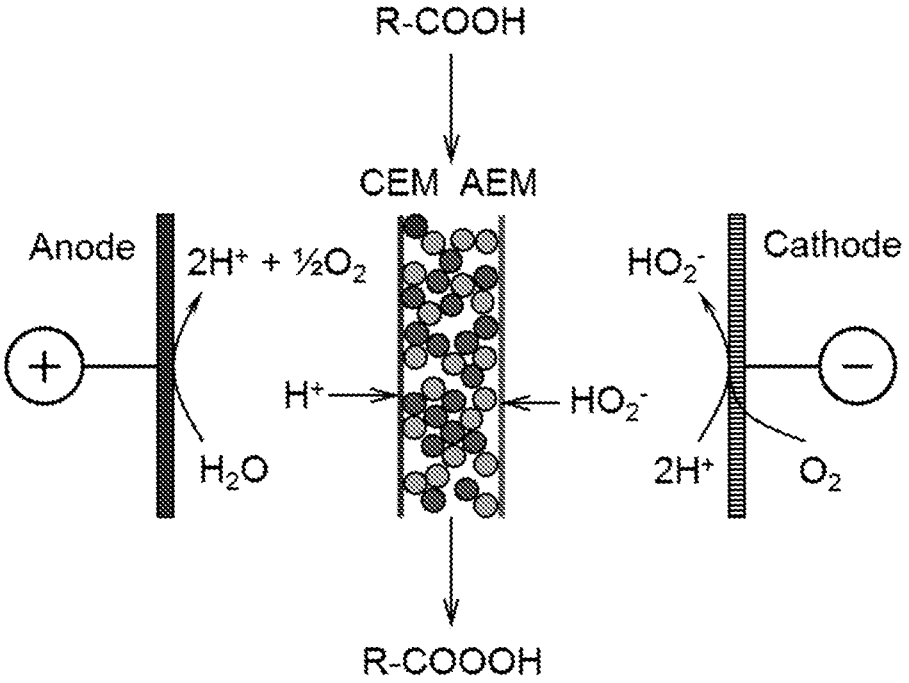

FIG. 8 illustrates a process for preparing peroxy carboxylic acids wherein a reactant (carboxylic acid) is introduced into the concentrate compartment and reacts with $HO_2^-$ ions to form the product.

The present disclosure also provides as embodiments:

A. A process for the electrochemical production of a compound in an electrochemical cell, the process comprising:

producing ions in aqueous medium at an electrode, optionally reacting the ions with a compound to yield an ionic reaction product, transporting said ions or ionic reaction product through an ion selective membrane into a compartment of the electrochemical cell, wherein the ions or ionic reaction products are at least subjected to a chemical reaction so as to form the compound, wherein the membrane is an anion exchange membrane or cation exchange membrane and withdrawing a liquid stream comprising the compound from the compartment, wherein said compartment comprises water and a solid ion-conductive material, wherein water molecules migrate with said ions through anion exchange membrane or cation exchange membrane due to electro osmosis drag, and wherein all water is supplied into the compartment through the membranes.

B. A process according to Embodiment A, wherein $O_2$ is reduced at a gas diffusion electrode cathode to form $HO_2^-$, wherein said $HO_2^-$ reacts with an organic compound to form an anion in the catholyte, wherein said anion is transported from said catholyte through an anion exchange membrane into the compartment and reacts in said compartment to form the product compound.

C. A process according to Embodiment B, wherein said organic compound is an alcohol and said anion is a carboxylate anion.

D. A process according to Embodiment C, wherein $HO_2^-$ anions also enter said compartment from said catholyte through said anion exchange membrane and react with at least said carboxylate anion to form a peroxy carboxylic acid.

E. A process according to any of embodiments A-D, wherein an organic compound is oxidized at the anode to give an anion, the process further comprising circulating anolyte comprising said anion into the catholyte compartment, thereby allowing for transporting the anions through the anion exchange membrane into the compartment comprising solid ion-conductive material.

F. A process according to any of embodiments A-E, comprising producing $HO_2^-$ anions at a cathode, transporting said $HO_2^-$ anions through an anion exchange membrane into said compartment, and reacting said anions with a compound in said compartment to form the product.

The invention will now be illustrated by the following examples which do not limit the invention or the claims.

EXAMPLE 1

Comparative

A plate-and-frame type electrochemical cell having 10 $cm^2$ active surface area, with a compartment thickness of 2 mm was used and equipped with platinized titanium as anode from DeNora, with Nafion 115 as cation exchange membrane, with Neosepta AHA as anion exchange membrane and a gas diffusion electrode supplied by Gaskatel, Germany, i.e. with an anolyte compartment and a catholyte compartment. 75 ml 0.4 M KOH aqueous solution was used as catholyte, 40 ml 0.5 M $K_2SO_4$ aqueous solution as concentrate (in the middle compartment) and 75 ml 0.4 M $H_2SO_4$ aqueous solution as anolyte and were circulated from double walled glass vessels into the electrochemical cell and back into the glass vessels at 80 ml/min. Circulating concentrate illustrates no water feed to the concentrate compartment. Pure oxygen was supplied to the GDE at 80 ml/min. A Neslab RTE 7 thermostatic bath was used to maintain temperature between 10 and 25° C. Delta Elektronika ES 030-5 was used as power supply and set to 0.5 A, the cell voltage was monitored with a Metrahit 26M multimeter. The level of the electrolyte solutions was used to determine the volume during the experiment. Periodic sampling of catholyte and concentrate samples was done for determine hydrogen peroxide concentration by redox titration. Results are given in Table 1. The overall current efficiency was 83% with an energy consumption of 7.5 kWh/kg hydrogen peroxide. This example is comparative because no resin beads (or other solid ion-conductive materials) are used in the compartment between AEM and CEM.

TABLE 1

| Comparative Example 1 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | 3.8 | 0 | | | 0 | | |
| 3 | 3.4 | 0.19 | | | 0 | | |
| 15 | 3.4 | 1.0 | | | 0.02 | | |
| 30 | 3.5 | 1.8 | | | 0.11 | | |
| 45 | 3.5 | 2.7 | | | 0.26 | | |
| 60 | 3.5 | 3.6 | | | 0.53 | | |
| 75 | 3.5 | 4.3 | | | 0.86 | | |
| 90 | 3.5 | 5.0 | | | 1.2 | | |
| 120 | 3.5 | 6.3 | | | 2.4 | | |
| 150 | 3.5 | 7.3 | | | 3.7 | | |
| 180 | 3.5 | 8.2 | | | 5.3 | | |
| 240 | 3.8 | 9.3 | | | 8.9 | | |
| 300 | 3.8 | 10.2 | 53 | 13.0 | 13.3 | 60 | 2.2 |

EXAMPLE 2

Comparative

Comparative Example 2 was carried out as Comparative Example 1, except with 80 ml catholyte and anolyte and 60 ml concentrate and operating at 1 A. Results are given in Table 2. The overall current efficiency was 82% with an energy consumption of 10 kWh/kg hydrogen peroxide.

TABLE 2

| Comparative Example 2 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | — | 0 | | | 0 | | |
| 3 | 4.8 | 0.45 | | | 0.04 | | |
| 15 | 4.8 | 1.8 | | | 0.09 | | |
| 30 | 5 | 3.2 | | | 0.32 | | |
| 45 | 5.3 | 4.8 | | | 0.79 | | |
| 60 | 5.5 | 5.9 | | | 1.4 | | |
| 75 | 5.5 | 7.1 | | | 2.3 | | |
| 90 | 5.5 | 8.1 | | | 3.6 | | |
| 120 | 5.5 | 9.2 | | | 6.5 | | |
| 150 | 5.8 | 9.1 | | | 9.9 | | |
| 180 | 5.8 | 10.5 | | | 13.4 | | |
| 240 | 6.0 | 11.5 | | | 20.0 | | |
| 300 | 6.0 | 12.2 | 52 | 13.1 | 25.8 | 51 | 2.8 |

EXAMPLE 3

Comparative

As example 2, except with 100 ml catholyte and anolyte and having demineralized water as concentrate. Delta Elektronika SM120-25D was used as power supply for Example 3 and following examples. Example 3 is comparative. Results are given in Table 3. The overall current efficiency was 77% with an energy consumption of 174 kWh/kg hydrogen peroxide.

TABLE 3

| Comparative Example 3 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | — | 0 | | | 0 | | |
| 3 | 95 | 0.32 | | | 0 | | |
| 15 | 75 | 1.6 | | | 0.01 | | |
| 30 | 80 | 2.5 | | | 0.28 | | |
| 45 | 77 | 4.0 | | | 0.68 | | |
| 60 | 77 | 5.2 | | | 1.3 | | |
| 75 | 81 | 6.3 | | | 2.1 | | |
| 90 | 84 | 7.2 | | | 3.0 | | |
| 120 | 93 | 8.4 | | | 5.4 | 0.72 | |
| 150 | 86 | 9.0 | | | 8.2 | | |
| 180 | 85 | 9.8 | | | 11.1 | | |
| 240 | 96 | 7.3 | | | 16.7 | | |
| 300 | 97 | 10.7 | 48 | 13.2 | 21.6 | 0.84 | 2.7 |

EXAMPLE 4

As example 3, except with 90 ml catholyte and anolyte and with the concentrate compartment filled with Nafion NR50 beads resulting in a compartment thickness of 3.5 mm. Example 4 is according to the invention. The overall current efficiency was 80% with an energy consumption of 38 kWh/kg hydrogen peroxide. Results are given in Table 4.

TABLE 4

| Example 4 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | — | 0 | | | 0 | | |
| 3 | 18 | 0.32 | | | 0 | | |
| 15 | 19 | 1.6 | | | 0.05 | | |
| 30 | 21 | 3.3 | | | 0.32 | | |
| 45 | 21 | 4.6 | | | 0.75 | | |
| 60 | 21 | 5.8 | | | 1.4 | | |
| 75 | 23 | 6.8 | | | 2.4 | | |
| 90 | 25 | 7.7 | | | 3.4 | | |
| 120 | 25 | 9.0 | | | 6.2 | | |
| 150 | 28 | 9.9 | | | 9.3 | | |
| 180 | 29 | 10.5 | | | 12.9 | | |
| 240 | 30 | 11.2 | | | 19.2 | | |
| 300 | 30 | 11.7 | 50 | 13.1 | 24.8 | 1.6 | 2.4 |

EXAMPLE 5

Continuous Production

As example 4, except with 10 ml catholyte and anolyte. Example 5 illustrates the invention. Continuous operation for 5820 minutes (97 hours) was enabled by continuous removal of product from the concentrate vessel, thus maintaining 55 ml as concentrate, and replenishing anolyte and catholyte volume using demineralized water to the original level. At t=5520 min. 0.4 M KOH and 0.4 M $H_2SO_4$ were used to replenish catholyte and anolyte. The overall current efficiency was 64% with an energy consumption of 80 kWh/kg hydrogen peroxide. Results are given in Table 5. The achieved $H_2O_2$ concentration, e.g. more than 50 g/kg, is acceptable.

TABLE 5

| Example 5 - Continuous production | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | | 0.0 | | | 0.0 | | |
| 3 | 26 | 0.31 | | | 0.0 | | |
| 15 | 28 | 1.4 | | | 0.0 | | |
| 30 | 27 | 2.7 | | | 0.22 | | |
| 45 | 28 | 4.0 | | | 0.57 | | |
| 60 | 30 | 5.6 | | | 1.1 | | |
| 75 | 34 | 6.0 | | | 1.9 | | |
| 90 | 37 | 6.9 | | | 2.7 | | |
| 120 | 39 | 8.3 | | | 5.2 | | |
| 150 | 40 | 9.0 | | | 7.8 | | |
| 180 | 40 | 9.9 | | | 11.2 | | |
| 240 | 41 | 10.3 | | | 17.0 | | |
| 300 | 38 | 10.9 | | | 22.8 | | |
| 301 | — | | | | | | |
| 1157 | 34 | 13.7 | | | 61.3 | | |
| 1158 | 34 | | | | | | |
| 1200 | 36 | 8.6 | | | 57.1 | | |
| 1260 | 36 | 8.4 | | | 61.9 | | |
| 1350 | 35 | 8.8 | | | 63.8 | | |
| 1380 | 37 | 9.3 | | | 63.9 | | |
| 1440 | 36 | 9.6 | | | 65.0 | | |
| 1500 | 35 | 9.3 | | | 63.5 | 1.24 | |
| 1560 | 37 | 9.9 | | | 64.8 | | |
| 1620 | 35 | 10.1 | | | 64.7 | | |
| 1680 | 35 | 10.9 | | | 66.1 | | |
| 1682 | 39 | 7.1 | | | 67.0 | | |
| 2574 | 34 | 11.6 | | | 69.7 | | |

TABLE 5-continued

| Example 5 - Continuous production | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 2580 | 38 | 6.9 | | | 70.0 | | |
| 2640 | 38 | 6.7 | | | 67.1 | 1.29 | |
| 2700 | 36 | 7.0 | | | 67.8 | | |
| 2822 | 36 | 7.5 | | | 67.1 | | |
| 2940 | 36 | 7.9 | | | 68.9 | | |
| 3060 | 36 | 8.3 | | | 68.5 | | |
| 3065 | 35 | 6.0 | | | 68.1 | 0.95 | |
| 4008 | 32 | 13.8 | | | 68.7 | | |
| 4020 | 32 | 9.7 | | | 65.0 | | |
| 4080 | 33 | 11.2 | | | 66.7 | 1.25 | |
| 4144 | 33 | 12.2 | | | 64.4 | | |
| 4260 | 33 | 13.5 | | | 64.7 | | |
| 4404 | 30 | 14.3 | | | 55.8 | | |
| 4500 | 29 | 15.2 | | | 58.1 | | |
| 4505 | 24 | 4.7 | | | 57.5 | | |
| 5493 | 20 | 16.0 | | | 69.6 | | |
| 5520 | 21 | 12.2 | | | 67.7 | | |
| 5580 | 21 | 13.8 | | | 68.3 | 7.1 | |
| 5640 | 21 | 14.7 | | | 66.8 | | |
| 5760 | 23 | 15.4 | | | 66.5 | | |
| 5820 | 22 | 15.7 | 65 | 13.2 | 67.2 | 5.38 | 1.7 |

EXAMPLE 6

Figure 9:
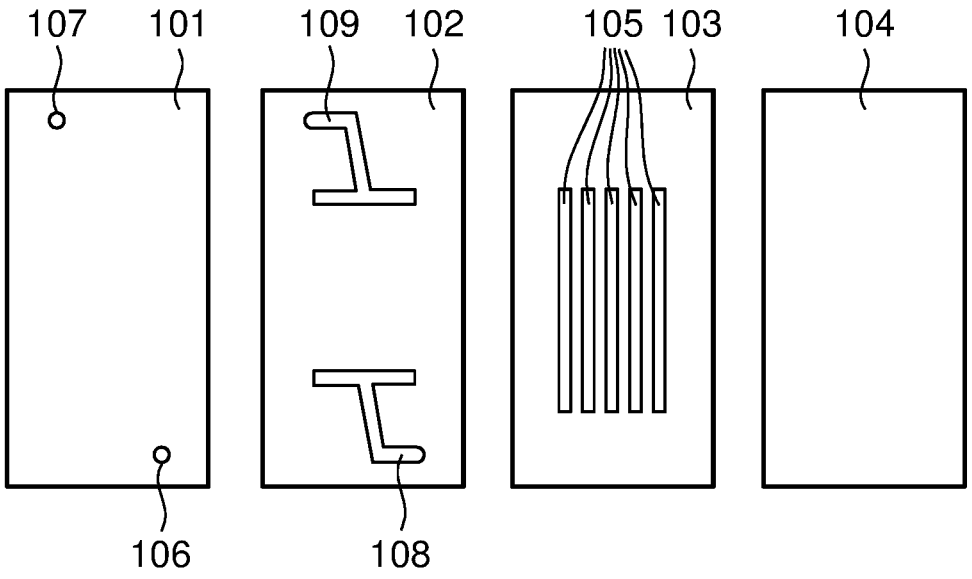

Example 6 is as example 1, except with 100 ml catholyte and anolyte and 60 ml demineralized water as concentrate with the concentrate compartment constructed out of two Nafion 1110 cation exchange membranes. Horizontal bars of approx. 2-3 mm width were cut out of one of the Nafion 1110 membranes. In this way, example 6 is according to the invention. The compartment construction is schematically illustrated in FIG. 9. Between Nafion 115 as CEM (101) and Neosepta AHA as AEM (104), two CEM membranes (102 and 103) were placed. Membrane 101 has inlet 106 and an outlet 107 opening and membrane 102 has an inlet 108 forming a liquid flow connection from inlet 106 to channels 105, and has outlet 109 forming a liquid flow connection from channels 105 to outlet 107. Hence, membrane 102 is configured for collecting liquid from the horizontal flow channels 105 in membrane 103, at opposed ends thereof, and flow therein into the outlet opening respectively inlet opening for concentrate in membrane 101. Horizontal flow channels 105 are for flow of demineralized water and have 2-3 mm width. Results are given in Table 6. The overall current efficiency was 94% with an energy consumption of 9.4 kWh/kg hydrogen peroxide.

TABLE 6

| Example 6 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | — | 0.0 | | | 0.0 | | |
| 3 | 4.5 | 0.21 | | | 0.02 | | |
| 15 | 4.8 | 0.79 | | | 0.03 | | |
| 30 | 5.2 | 1.6 | | | 0.09 | | |
| 45 | 5.4 | 2.4 | | | 0.17 | | |
| 60 | 5.6 | 3.1 | | | 0.31 | | |
| 75 | 5.8 | 3.9 | | | 0.45 | | |
| 90 | 6.0 | 4.4 | | | 0.68 | | |

TABLE 6-continued

| Example 6 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 120 | 6.0 | 5.6 | | | 1.3 | | |
| 150 | 6.4 | 6.7 | | | 2.2 | | |
| 180 | 7.5 | 7.6 | | | 3.4 | | |
| 240 | 5.2 | 9.0 | | | 6.2 | | |
| 300 | 5.1 | 10.0 | 48 | 13.2 | 9.5 | 4.6 | 2.2 |

EXAMPLE 7

As example 6, except with 40 ml demineralized water as concentrate and operating at 1 A. Results are given in Table 7. Example 7 is according to the invention. The overall current efficiency was 68% with an energy consumption of 29 kWh/kg hydrogen peroxide.

TABLE 7

| Example 7 | | | | | | | |
|---|---|---|---|---|---|---|---|
| | | catholyte | | | concentrate | | |
| Time [min] | $V_{cell}$ [V] | $H_2O_2$ [g/kg] | EC [mS/cm] | pH [—] | $H_2O_2$ [g/kg] | EC [mS/cm] | pH [—] |
| 0 | — | 0.0 | | | 0.0 | | |
| 3 | 6.3 | 0.14 | | | 0.0 | | |
| 15 | 7.5 | 1.6 | | | 0.07 | | |
| 30 | 8.1 | 3.0 | | | 0.21 | | |
| 45 | 8.8 | 4.4 | | | 0.61 | | |
| 60 | 9.5 | 5.5 | | | 1.2 | | |
| 75 | 11 | 6.6 | | | 1.9 | | |
| 90 | 12 | 7.6 | | | 3.1 | | |
| 120 | 14 | 8.8 | | | 5.7 | | |
| 150 | 16 | 9.4 | | | 8.6 | | |
| 180 | 18 | 9.8 | | | 11.0 | | |
| 240 | 19 | 10.8 | | | 17.1 | | |
| 300 | 20 | 11.2 | 49 | 13.1 | 21.6 | 5.3 | 1.9 |

The obtained results and further results are summarized in Table 8. Herein, concentrate refers to the compartment between AEM and CEM. CE is the current efficiency and EC is the electrical conductivity. Q is the energy consumption. For comparing results between concentrate compartments of 2 mm and 3.5 mm thickness, it must be taken into account that reducing the compartment thickness decreases Ohmic drop.

TABLE 8

| overview | | | | | | | | |
|---|---|---|---|---|---|---|---|---|
| Ex. | Time [h] | Current [A] | Concentrate/ compartment | $H_2O_2$ [g/kg] | CE [%] | EC [mS/cm] | pH [—] | Q [kWh/kg] |
| 1 | 5 | 0.5 | 0.5M $K_2SO_4$ | 13.3 | 83% | 60 | 2.2 | 7.5 |
| 2 | 5 | 1.0 | 0.5M $K_2SO_4$ | 25.8 | 82% | 51 | 2.8 | 10 |
| 3 | 5 | 1.0 | Demi-water | 21.6 | 77% | 0.84 | 2.7 | 174 |
| 4 | 5 | 1.0 | NR50 bead + demi-water | 24.8 | 80% | 1.6 | 2.4 | 38 |
| 5 | 97 | 1.0 | NR50 bead + demi-water | ≈65 | 64% | 0.95-5.38 | 1.7 | 80 |
| 6 | 5 | 0.5 | Nafion N1110 | 9.5 | 94% | 4.6 | 2.2 | 9.4 |
| 7 | 5 | 1.0 | Nafion N1110 | 21.6 | 68% | 5.3 | 1.9 | 29 |

The invention claimed is:

1. A reactor system comprising an electrochemical cell reactor, wherein the electrochemical cell reactor comprises an anode, a cathode, a cation exchange membrane and an anion exchange membrane, wherein said anion exchange membrane is adjoined to said cathode or defines a catholyte compartment with said cathode, wherein the electrochemical cell reactor further comprises a product compartment between said cation exchange membrane and said anion exchange membrane, wherein said product compartment comprises an outlet for a liquid stream, wherein said product compartment comprises a solid ion-conductive material, wherein said solid ion-conductive material comprises an ion exchange material and has channels configured to permit a liquid to flow through said solid ion-conductive material to said outlet, wherein the product compartment has no inlet opening for liquids.

2. The reactor system according to claim 1, wherein said solid ion-conductive material is in contact with both said cation exchange membrane and said anion exchange membrane.

3. The reactor system according to claim 1, wherein said cathode is a gas diffusion electrode.

4. The reactor system according to claim 1, wherein said anion exchange membrane, said cation membrane, or both, are impermeable for convective flow of liquids.

5. A process for the electrochemical production of hydrogen peroxide in the reactor according to claim 1, the process comprising:

producing $H^+$ cations at the anode, producing $HO_2^-$ anions at the cathode, transporting said $H^+$ cations through the cation exchange membrane into the product compartment of said electrochemical cell, transporting said $HO_2^-$ anions through the anion exchange membrane into said product compartment, wherein hydrogen peroxide is formed in said product compartment; and withdrawing a hydrogen peroxide solution with a concentration of at least 50 g $H_2O_2$/l through an outlet from said product compartment, wherein water molecules migrate with said anions through the anion exchange membrane and/or with said cations through the cation exchange membrane due to electro osmosis drag, and wherein all water is supplied into the product compartment through the membranes.

6. The process according to claim 5, wherein said solid ion-conductive material comprises cation exchange material and/or anion exchange material.

7. The process according to claim 5, wherein the hydrogen peroxide solution has an electrical conductivity of less than 50 mS/cm.

8. The process according to claim 5, wherein said product compartment comprises a fixed packed bed comprising cation exchange material resin beads.

9. The process according to claim 8 wherein said packed bed further comprises anion exchange material resin beads.

10. The process according to claim 5, wherein said solid ion-conductive material comprises a spacer comprising an ion exchange material.

11. The process according to claim 10, wherein said spacer is in the form of a woven or non-woven fabric and comprises fibers of the ion exchange material.

12. The process according to claim 5, wherein the pH of said hydrogen peroxide solution at said outlet is lower than 8.

13. The process according to claim 5, wherein said hydrogen peroxide solution has an electric conductivity lower than 5 mS/cm at said outlet.

* * * * *